United States Patent [19]

Cherry

[11] Patent Number: 4,898,281

[45] Date of Patent: Feb. 6, 1990

[54] BEAUTICIAN'S CADDY

[76] Inventor: Sophia Cherry, 2539 W. 77th St., Chicago, Ill. 60652

[21] Appl. No.: 289,750

[22] Filed: Dec. 27, 1988

[51] Int. Cl.[4] ..... A47F 7/00

[52] U.S. Cl. ..... 211/13; 211/169

[58] Field of Search ..... 211/13, 70, 70.6, 70.1, 211/133, 163, 169, 59.1

[56] References Cited

U.S. PATENT DOCUMENTS

| | | | |
|---|---|---|---|
| D. 156,950 | 1/1950 | Formhals | 211/59.1 |
| 1,801,058 | 4/1931 | Sutcliffe | 211/163 |
| 3,195,736 | 7/1965 | Bomar | 211/163 |
| 3,532,221 | 10/1970 | Kaluhiokalani et al. | 211/70.6 |
| 4,415,089 | 11/1983 | Ruffa | 211/13 |
| 4,446,972 | 5/1984 | Sussman | 211/60.1 X |

*Primary Examiner*—Robert W. Gibson, Jr.
*Attorney, Agent, or Firm*—Paul H. Gallagher

[57] ABSTRACT

A stand having an upright panel unit thereon, the panel including spaced boards, one of which is perforated. On a front side of the panel open containers are demountably secured, for loosely receiving articles. On the rear side are racks, each including a bar and pegs mounted in the bar, for holding hair curlers loosely fitted thereover. On the front at the bottom, is a trough divided into open containers, and on the rear at the bottom, is a shelf with holes for loosely receiving instruments.

12 Claims, 2 Drawing Sheets

(FRONT)
12
14
16
18
20
24
28a
28b
30
32
34
36
37
38
40
42
44
47
48
52
53
54
56
62
66
68
80
82

(BACK)
12
14
16
18
20
26
28a
28b
30
32
34
36
37
38
42
44
54
64
66
68
70
71
72
73
74
76
80

BEAUTICIAN'S CADDY

FIELD OF THE INVENTION

The invention resides in the beautician's, cosmetologist's, or beauty culture field, having to do particularly with handling the hair dressing articles and implements. More especially, it has to do with the problem of keeping the hair dressing articles and implements separated in orderly fashion, convenient for quickly picking them up by the beauty operator who many times has only one hand accessible for the purpose.

OBJECTIONS OF THE INVENTION

A broad object of the invention is to provide a device for use by a beauty operator in the process of performing services for a patron, having the following features and advantages:

1. It is a portable carrier, or caddy, that enables the operator to have all the hair dressing articles and implements used by her, in an orderly display, and easily accessible, both from the standpoint of location and individual accessibility.

2. It is extremely versatile, being capable of accommodating a wide variety of articles that are used by the operator.

3. It is extremely simple in construction, and light in weight and easily manipulated by the operator, both in moving it to a location and in manipulating it in the course of performing services on a patron's hair.

4. It includes a stand that rests directly on the floor, and a panel in an upper position for supporting articles in that upper position and thus convenient for the operator.

DESCRIPTION OF A PREFERRED EMBODIMENT:

Figure 1:
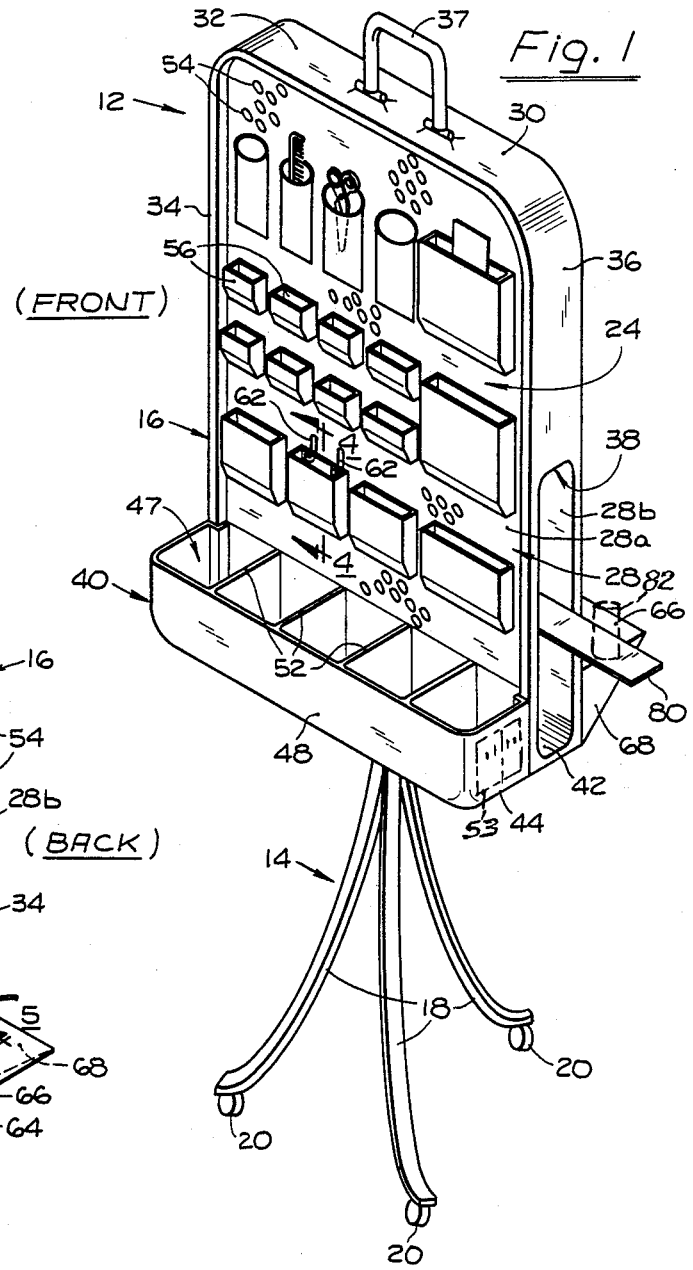
FIG. 1 is a perspective view showing the front side of the device at an angle.

Referring to the invention in general, the device is designed and constructed for use by a beauty operator in performing various hair dressing services, i.e. haircutting coloring, perming, straightening, setting, etc., on a patron. It is designed for supporting all of the hair dressing articles and implements used by the operator in such services. It is moreover designed for easy portability, so that the operator can easily move it and have it available and accessible as she moves to various positions while performing services on the patron's hair. Very often, or most times, during this operation, the operator has only one hand available for picking up the articles intended, since the other hand is many times occupied with temporary holding of strands of hair. Heretofore the articles were normally found in a random pile or in various containers, or locations, or otherwise not readily accessible to the operator. The device in this case is effective for carrying out the intended purpose, of rendering it easy for the operator to reach all of the articles intended, and may be referred to as a caddy, or a carrier.

Referring in detail to the accompanying drawings, the device is indicated as a whole at 12, and includes a stand 14 and a panel or panel unit 16. The stand 14 may be of any conventional construction, while the panel 16 includes special features referred to hereinbelow. Each of these components, namely the stand and the panel, will be described in detail hereinbelow, but an overall feature is that the panel is designed and constructed to be positioned entirely at the top of the stand, for providing great convenience to the operator, being thus at an appropriate elevation, while the stand itself does not, as a stand, function in supporting any of the instruments directly, but supports the panel.

For convenience in visualization of the device, the whole unit may be for example 5 feet tall and the panel unit 2½ feet wide by 3 feet high. These dimensions are obviously only an example, and the invention is not to be limited thereby.

The stand 14 may consist of three legs 18, for example, having casters 20. It is an important feature of the invention that the device be easily movable or portable, and the casters provide such easy movability, enabling it to be moved or shoved easily. However, it is within the scope of the invention that the device may be skidded, and hence the casters are not essential, although preferred. It is also preferred that the device be readily turned about an internal vertical axis 22, by the operator in use thereof, to present the front or rear side, selectively, to access by the operator. Additionally it is preferable that it be turnable easily by one hand, to accommodate the operator when she has only one hand accessible, as referred to above.

Figure 2:
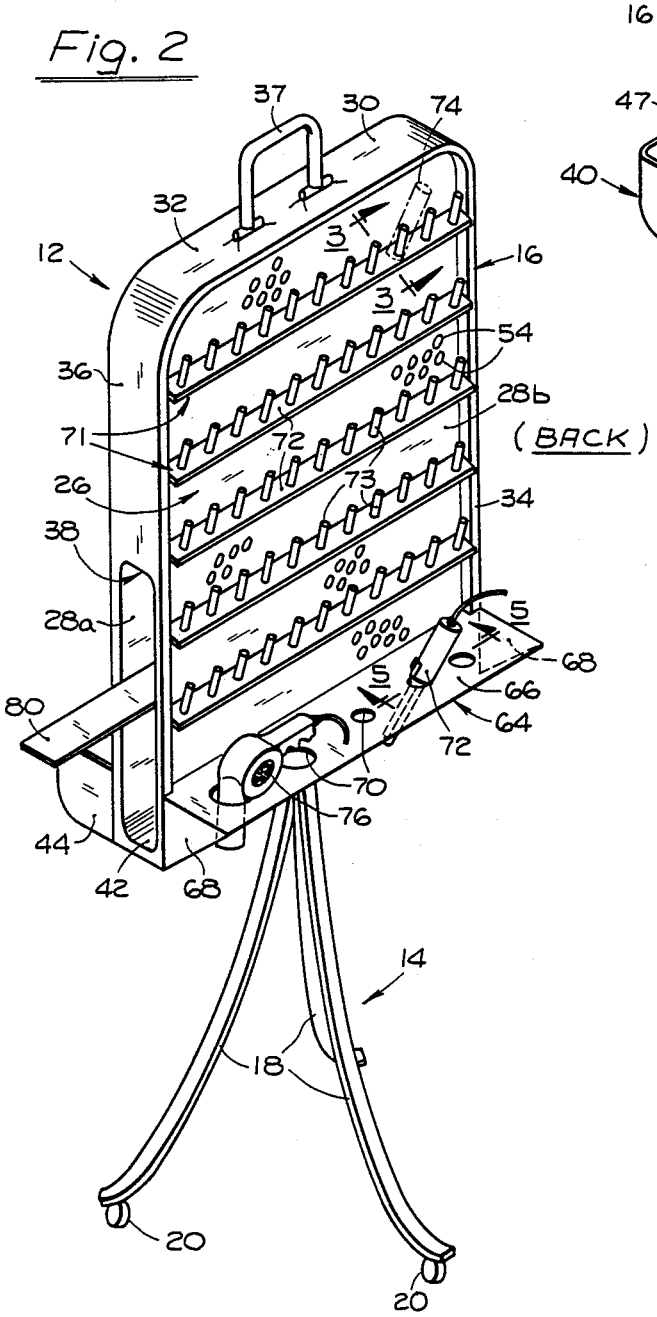
FIG. 2 is a perspective view of the rear side of the device, at an angle different from that of FIG. 1.
Figure 3:
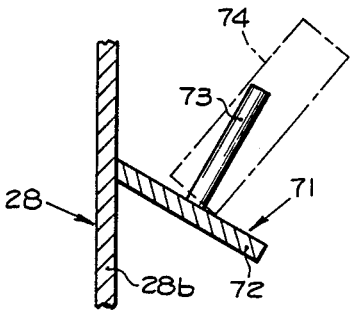
FIG. 3 is a detail sectional view taken at line 3—3 of FIG. 2.

Reference is next made to the panel or panel unit 16. This component, as apparent from the drawings, and as referred to above, is positioned at an elevated position, on the stand, and at that position it is convenient for reaching by the operator. The panel has a front side shown in FIG. 1 and indicated at 24, while it has a rear side as shown in FIG. 3, indicated at 26. The panel or panel unit 16 includes panel elements or boards 28, including a front board **28*a*, and a rear board 28*b*, mounted in and secured to a perimeter strip 30 which may also be in the form of a board, having a top element 32 and side elements 34, 36. The panel elements and the perimeter strip may be secured together in any suitable manner, such as by glue, screws, etc. The perimeter strip is wider than the thickness of the two elements 28*a*, 28*b*, together, thereby providing extending side edges, as to be noted particularly in FIG. 2. A manipulating handle 37** is secured to the top of the panel.

The side element 36 is provided with a slot 38 adjacent the bottom thereof for purpose to be referred to later, but showing the spacing between the panel elements **28*a*, 28*b***.

At the bottom of the panel unit is a base member indicated in its entirety at 40, having a bottom element 42 forming the bottom of the panel unit. The base member 40 has a front portion 44, extending forwardly of the panel member and having a surrounding wall element 48, and an open top, forming a container or trough 47. If desired, the container may be provided with partitions 52 to form small containers, or individual cells or boxes. The bottom element 42, constituting the bottom element of the entire panel unit as stated, directly engaging and secured to the stand in mounting the panel on the stand. An electrical connector or outlet 53 (FIG.

1) may be provided at a convenient location, such as in the end wall 48 at the end of the base member 40, for providing connection between an electrical source and various electrical instrumentalities on the device.

Figure 5:
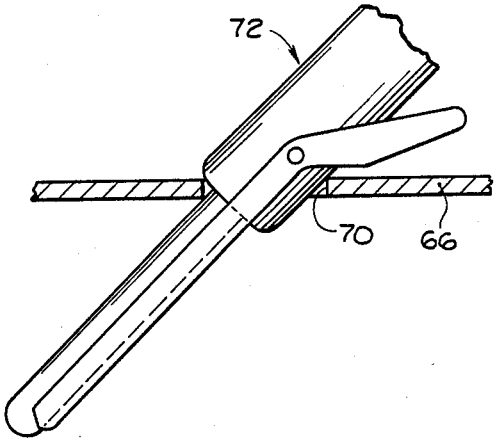
FIG. 5 is a view showing an alternate arrangement for mounting one of the beautician's implements.
Figure 4:
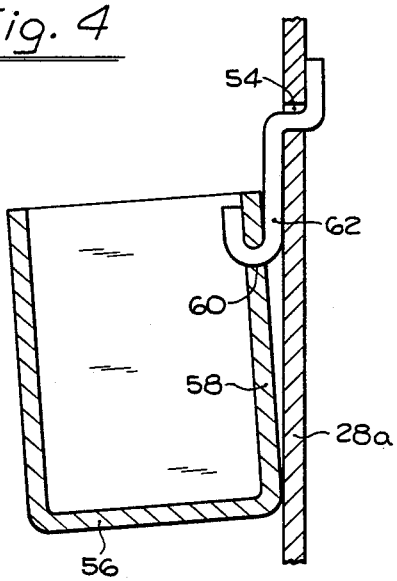
FIG. 4 is a sectional view taken at line 4—4 of FIG. 1.

Preferably the front panel element or board 28*a* is perforated, having a plurality of holes 54 for use in mounting various containers and instruments thereon. FIG. 1 shows a plurality of containers 56 which may be similar to each other, except for size and proportions, and each including an open top and adapted for receiving instruments and other articles 57 placed therein by the operator. Preferably these containers are detachably mounted on the panel element as illustrated in FIG. 5 which shows the front panel element 28*a* and a hole 54 therein, and a container 56. The container has a back element 58 having a plurality of holes 60 therein, and the container is mounted on the panel element 28by means of hooks 62 of known kind. Each has a front element projected through a hole 60 and a top element extended through the hole 54 in the panel element.

The containers thus are detachably mounted in a known manner, and can be mounted or not, as desired, and in various locations, and of course different kinds of containers may be utilized.

The panel unit is well adapted for accommodating different phases of the operator's work. While the containers 56 on the front side of the panel, are useful for holding various items that are dropped thereinto, such as various lotions and chemical solutions, and wave rods of various sizes and colors, clips, combs, brushes, etc. The rear side is adapted for holding various other items, such as hair rollers and similar items. On the rear side, as shown in FIGS. 2 and 3, are a plurality of horizontal racks indicated generally at 71, each including a board or base 72 and pegs 73 mounted on the board. The boards may conveniently be disposed at an angle as indicated and extend into engagement with the extending side edges of the elements 34, 36, of the perimeter strip, to which they are secured by suitable means, such as screws, and the pegs preferably are inclined upwardly in outward direction. Hair curlers 74 are loosely fitted over the pegs, and held there for easy and quick removal. Any hollow items that can be so fitted over the pegs can be accommodated. The pegs are of such length that the curlers can be mounted thereon only one-deep, so that it will not be necessary to remove an outer one to gain access to an inner one.

In addition to the containers 56, and the racks 71, the device is provided with means for detachably mounting various instruments used by the operator. For this purpose, the panel is provided with means 64 in the form of a shelf or deck on the rear side at the lower end thereof. The shelf includes a horizontal top element 66 and vertical end brace elements 68, and is secured to the panel structure in a suitable manner. The top element is provided with relatively large holes 70, for receiving the instruments referred to, such as curling irons 72, hair blow dryer 76, and brushes 78. The instruments are put in position by merely inserting an end of each into one of the holes, and the instrument remains in position by gravity, although they may be in a tilted or canted position.

Mounted in the slot 38 is a tray 80, extending to the exterior so mounted for vertical manual adjustment. It serves to support any of various articles that the operator might have to pick up quickly, or that cannot be conveniently mounted or hung in another manner. Principal articles to be accommodated by the tray are containers of solutions as indicated at 82. The tray 80 may be used also for hanging articles thereon that have handles that enable them to be hung.

I claim:

1. A beautician's caddy comprising, a stand, an upright panel unit having broad faces on opposite sides thereof, mounted on and carried by the stand, and positioned entirely thereabove, the caddy being easily movable by a user, and means detachably and demountably supporting beautician's articles on the panel in an arrangement distributed thereon in which each article is accessible to the user, independently of the others, by merely grasping and withdrawing it.

2. A beautician's caddy according to claim 1 and including, such supporting means on each of opposite sides of the panel.

3. A beautician's caddy according to claim 1 wherein, the supporting means is operative for so supporting the articles in position only one-deep in direction outwardly from the face of the panel, and thereby eliminating the arrangement in which more than one article is positioned on a single line extending through the face of the panel.

4. A beautician's caddy according to claim 1 wherein, the supporting means includes a plurality of supporting members, themselves demountably secured on the panel, whereby to enable the supporting members to be so secured at selected positions on the panel, and in greater or lesser numbers.

5. A beautician's caddy according to claim 1 wherein, the supporting means includes a plurality of pegs secured on one face of the panel adapted for mounting hollow articles thereon.

6. A beautician's caddy according to claim 1 wherein, the supporting means includes containers demountably secured on the panel, for holding selected ones of said articles, and the containers being generally open to provide easy access to the articles therein, by the user.

7. A beautician's caddy according to claim 5 wherein, the supporting means includes mounting strips each including a plurality of said pegs, and the mounting strips being secured directly to the panel.

8. A beautician's caddy according to claim 1 wherein, the panel includes a perforated board, and the supporting means includes mounting hooks removably hooked in the holes in the perforated board.

9. A beautician's caddy comprising, a stand, an upright panel unit on the stand, having broad faces on opposite sides thereof, the panel unit including relatively thin panel elements constituting the main portion of the panel, and having oppositely and outwardly directed flat sides constituting said broad faces, the panel unit also including a perimeter strip surrounding the panel elements and having a dimension substantially greater than the panel elements in direction of the thickness of the board, and forming a border of the panel unit, supporting means on each of the opposite faces of the Panel unit including a plurality of supporting members removably secured on the panel unit for detachably supporting the beautician's articles, the panel unit including a base member at the bottom thereof forming an upwardly opening container below the corresponding broad face.

10. A beautician's caddy according to claim 9 wherein, the panel unit includes a shelf on the side thereof opposite said base member and at the bottom of the panel unit, the shelf having a horizontal top element with holes therein for receiving beautician's instruments.

11. A beautician's caddy according to claim 9 wherein, the panel elements are spaced apart in direction perpendicular to their broad faces, tray mounted in the space between the panel elements, having an outer end extending to the exterior and being vertically manually adjustable, the tray being adapted for supporting articles on its outer end.

12. A beautician's caddy according to claim 1 wherein, the panel unit includes, on one of its broad faces, racks for supporting articles each including a base extending across the broad face, and secured to other elements of the panel unit, and pegs mounted in the base for receiving hollow articles fitted thereover.

* * * * *